US005090652A

United States Patent [19]

Cattaneo

[11] Patent Number: 5,090,652

[45] Date of Patent: Feb. 25, 1992

[54] CONCEALED DEVICE FOR WALL-MOUNTING AN ITEM OF WALL FURNITURE

[75] Inventor: Carlo Cattaneo, Figino Serenza, Italy

[73] Assignee: Camar S.p.A., Como, Italy

[21] Appl. No.: 495,841

[22] Filed: Mar. 19, 1990

[30] Foreign Application Priority Data

Mar. 20, 1989 [IT] Italy ..... 19823 A/89
Nov. 24, 1989 [IT] Italy ..... 22501 A/89

[51] Int. Cl.[5] ..... A47B 96/06

[52] U.S. Cl. ..... 248/222.1; 248/225.2; 312/245; 24/592

[58] Field of Search ..... 248/220.2-225.2; 312/245, 246; 24/590-595

[56] References Cited

U.S. PATENT DOCUMENTS

| | | | |
|---|---|---|---|
| 3,946,979 | 3/1976 | Ehlebracht et al. | 248/476 X |
| 4,143,846 | 3/1979 | Rock et al. | 248/222.1 X |
| 4,220,809 | 9/1980 | Hennessey et al. | 312/245 X |
| 4,323,213 | 4/1982 | Röck et al. | 248/222.1 |
| 4,936,534 | 6/1990 | Cattaneo | 24/592 X |

FOREIGN PATENT DOCUMENTS

| | | | |
|---|---|---|---|
| 648598 | 5/1964 | Belgium | 312/245 |
| 246687 | 11/1987 | European Pat. Off. | 312/245 |
| 2717169 | 11/1978 | Fed. Rep. of Germany | 312/245 |
| 3111357 | 2/1983 | Fed. Rep. of Germany | 312/245 |

*Primary Examiner*—Renee S. Luebke
*Assistant Examiner*—Suzanne L. Dino
*Attorney, Agent, or Firm*—Hedman, Gibson & Costigan

[57] ABSTRACT

A concealed device for wall-mounting an item of wall furniture comprising, in combination: a plate to be fixed to the furniture item, a coupling element articulatedly secured to said plate and arranged to engage a support member fixed to the wall, and first and second adjustment linkages acting between said plate and said coupling element to adjust both the vertical position of the coupling element relative to the plate and the angle formed between the plate and the coupling element. According to the invention, the coupling element consists of an independent coupling module, complete with said linkages. Said adjustment linkages are preferably accessible from both the inside and the outside of the furniture item.

16 Claims, 7 Drawing Sheets

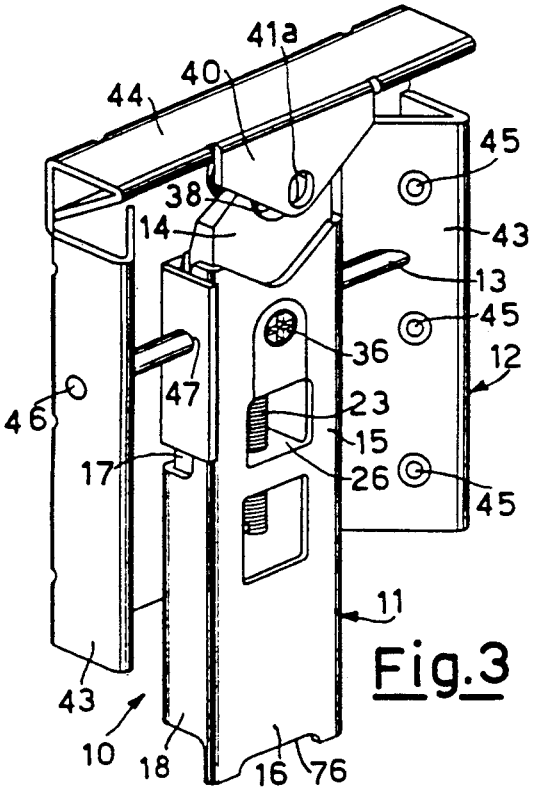
Fig.3
Fig.12
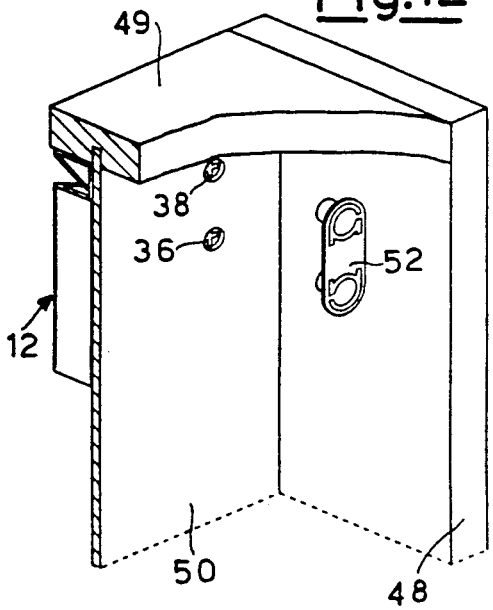
Fig.11
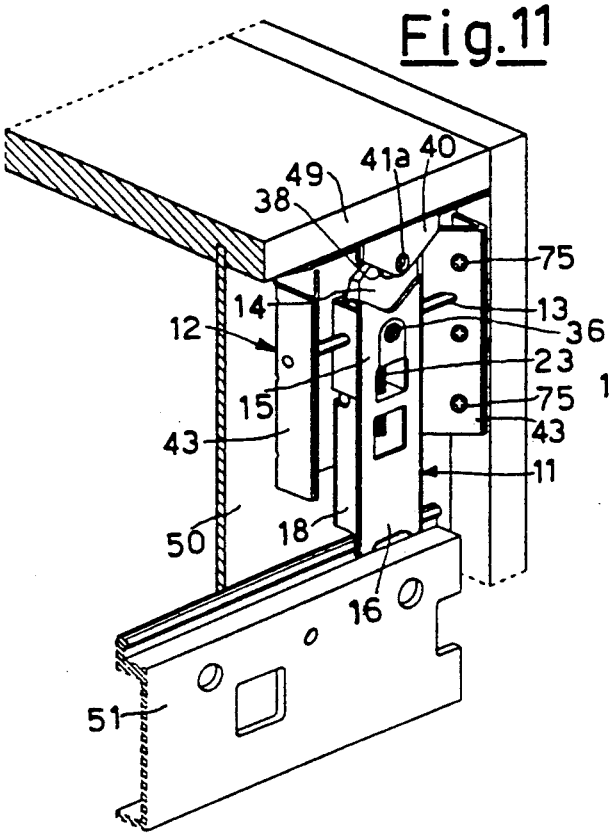
Fig.13
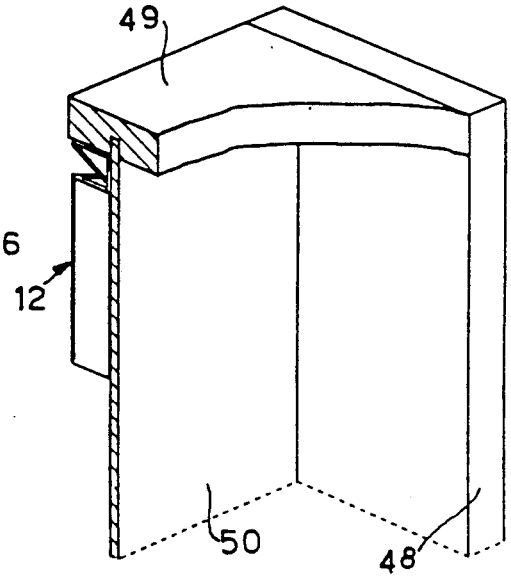

11
12
13
15
16
18
23
26
36
37
38
40
41a
42
43
44
45
46
76

CONCEALED DEVICE FOR WALL-MOUNTING AN ITEM OF WALL FURNITURE

This invention relates to a concealed device for wall-mounting an item of wall furniture, preferably but not necessarily a kitchen cabinet.

To wall-mount an item of wall furniture it is known to the expert of the art to use concealed devices in which a coupling element is articulatedly secured to a frame or plate in such a manner as to be adjustable in position relative to said plate.

The plate is fixed to the side and possibly also to the top panel of the furniture item to the rear of the back panel, the coupling element being freely engaged with a bar or hook plugs fixed into the wall, or with some other object suitable for the purpose. The aforesaid mounting devices are also provided with linkages comprising adjustment screws by which the vertical position of the coupling element relative to the plate, or its length, can be adjusted as can the angle formed between the plate and coupling element by virtue of the degree of opening of this latter. Said adjustment screws are accessible from the interior of the furniture item through one or more apertures provided in the back panel.

By this means the position of the item of wall furniture can be adjusted within certain limits in terms of its depth and height after it has been coupled to the wall by engaging the coupling elements of the devices fixed to the sides of the furniture item with the bar or hooks fixed to the wall.

Mounting devices of the aforesaid briefly described type are described and illustrated for example in German patents 2,717,169, 3,036,984 and 3,111,357, to which reference should be made if further clarification is required on the state of the art in this specific field.

The known devices have however the serious drawback that the plate, coupling element and relative adjustment linkages are formed with operational interconnections such that the assembly represents an inseparable unit applicable to furniture designed specifically for this purpose, without adaptation being possible. A further drawback of known mounting devices is their reliability, which is only relative. This is due to the fact that the retention means provided between the plate and coupling element for preventing separation cannot be considered totally reliable, because of their nature. In this respect, they consist mostly of clinched portions made when the piece is finished, and/or retention lugs.

The known devices also have the drawback that the adjustment linkages are accessible only from the interior of the furniture item, which means that apertures have to be provided in the back panel of the furniture item, these apertures even if covered with caps are undesirable as they can disturb the overall appearance of the interior of the furniture item.

The overall object of the present invention is to obviate the drawbacks of the known art by providing a device having the characteristics defined in the accompanying claims.

The structural and operational characteristics of the invention and its advantages compared with the known art will be more apparent from the description given hereinafter with reference to the accompanying drawings which show one embodiment of a mounting device incorporating the principles of the invention. In the drawings:

FIG. 3 is a perspective view showing the device of the invention assembled, ie with the two units shown in FIG. 1 pivoted together;

FIG. 11 is a perspective view showing the device of the invention fitted to an item of wall furniture;

FIGS. 12 and 13 are two perspective views showing the appearance of the interior of the furniture item of FIG. 11 for different respective ways of using the device of the invention;

Figure 1:
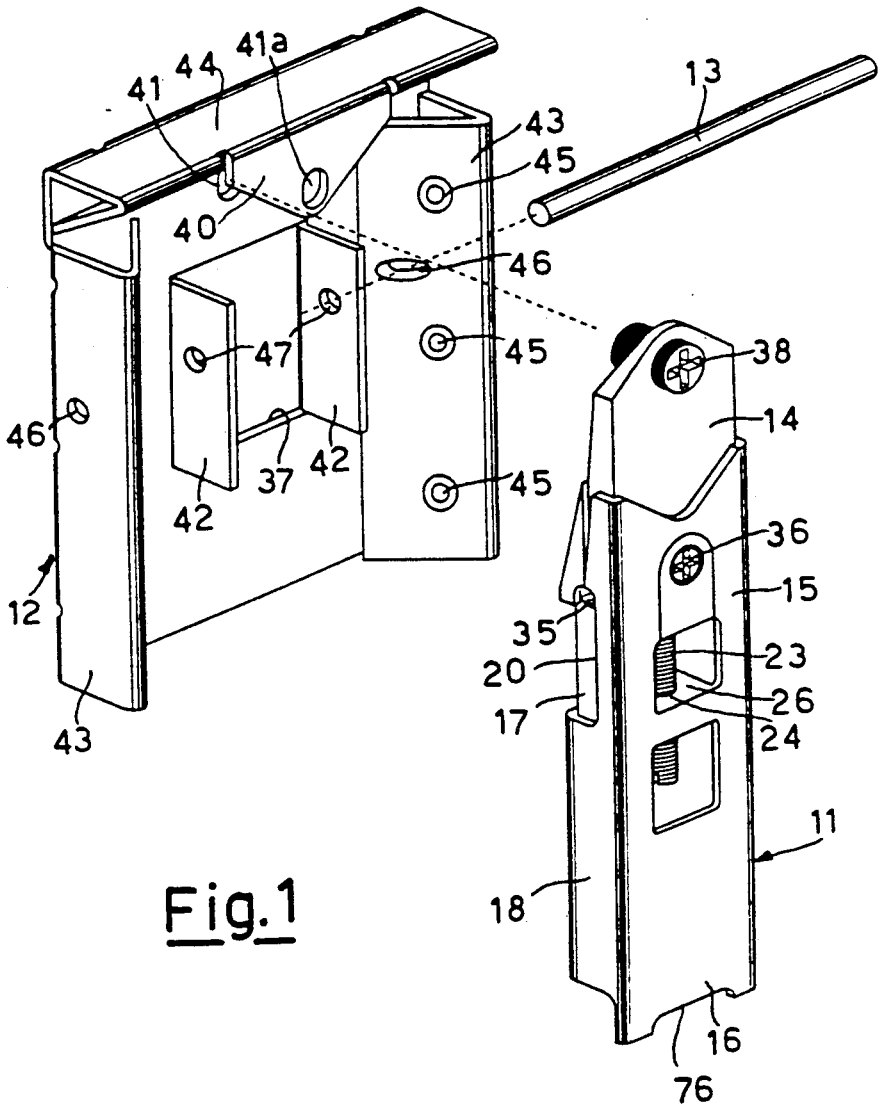
FIG. 1 is a partly exploded perspective view showing the two separate units (coupling module and plate) and the interconnecting pin which comprise the device of the invention.
Figure 2:
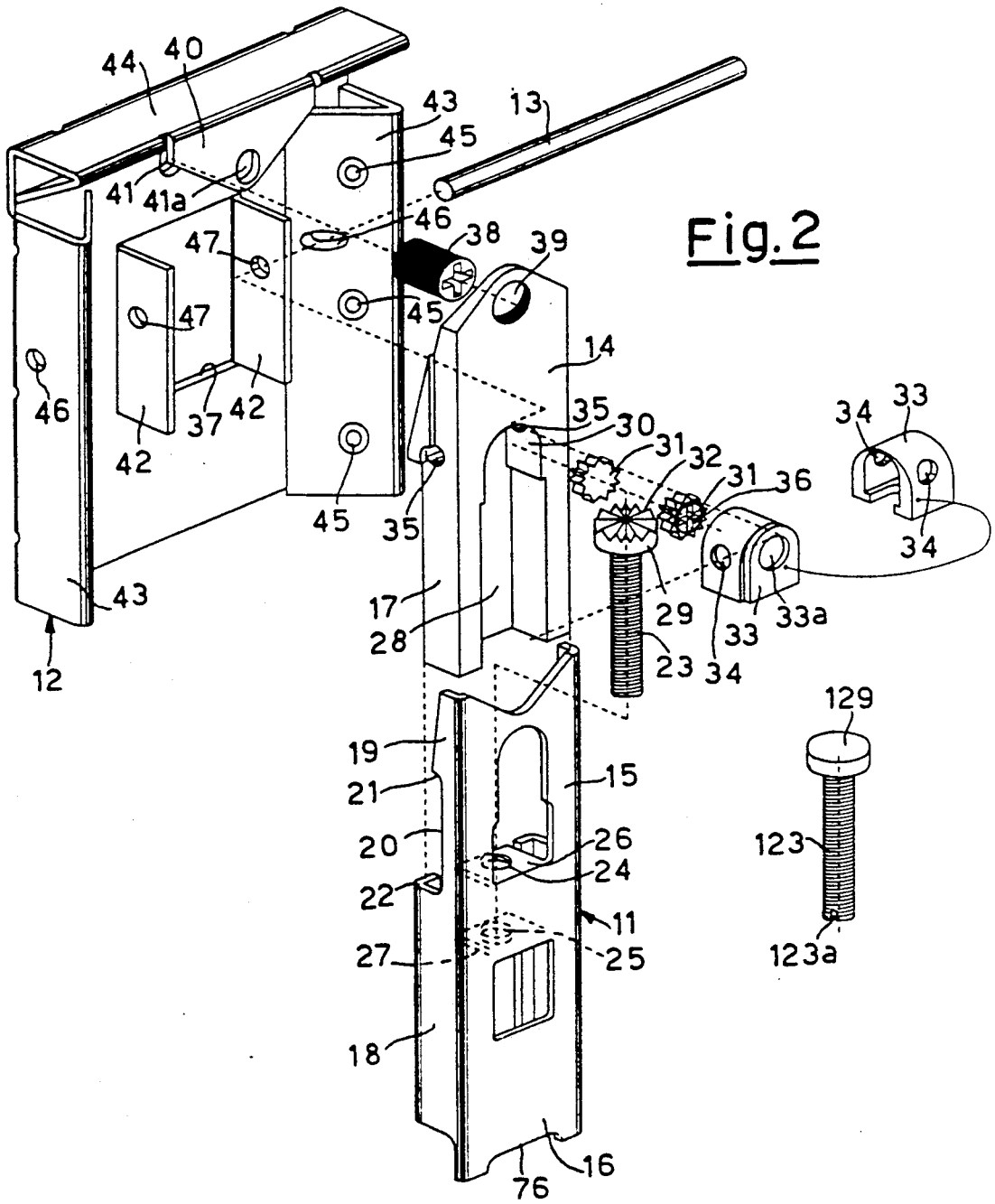
FIG. 2 is a completely exploded perspective view showing the mounting device of the invention.

With reference firstly to FIGS. 1, 2 and 3 of the drawings, the mounting device according to the invention is indicated overall by 10 (FIG. 3), and is structurally formed by combining a coupling module 11 with a plate 12, which can be of different configurations as explained hereinafter. A single pin 13 articulatedly connects the module 11 to the plate 12 (FIG. 1). As clearly shown in FIGS. 1 and 2 of the drawings, the module 11 is composed of a core 14 which is partly surrounded by an outer box casing 15 which by a projecting end 16 defines the actual coupling element of the device.

The core 14 and casing 15 are interconnected telescopically and together define a body of generally parallelpiped extending form. More specifically, the core 14 comprises profiled longitudinal side sections 17 (FIG. 2) contained within complementary guides 18 in the casing 15, which taper as at 19.

Said tapered portions 19 comprise a cut-out 20 defining end stops 21, 22, the purpose of which is explained hereinafter.

The core 14 and casing 15 can be moved relative to each other by a first linkage comprising a screw 23 which is screwed through aligned holes 24 and 25 provided in respective lugs 26 and 27 punched integrally out of the box casing 15.

The shank of the screw 23 extends through a passageway 28 in the core 14, whereas its head 29 sits within a housing 30 which is appropriately shaped to also receive two opposing pinions 31 which are engaged at 90° with a toothing 32 provided on said head 29 of the screw 23. A shaped plug 33 correspondingly closes the housing 30 to keep the head 29 and pinions 31 securely in position. Said plug 33 also comprises a through hole 34 aligned with the through holes 35 of the core 14, to receive the pin 13 for articulatedly connecting the coupling module 11 to the plate 12, said pin 13 also passing through said cut-outs 20.

Figures 4, 5, 6, 7, 8:
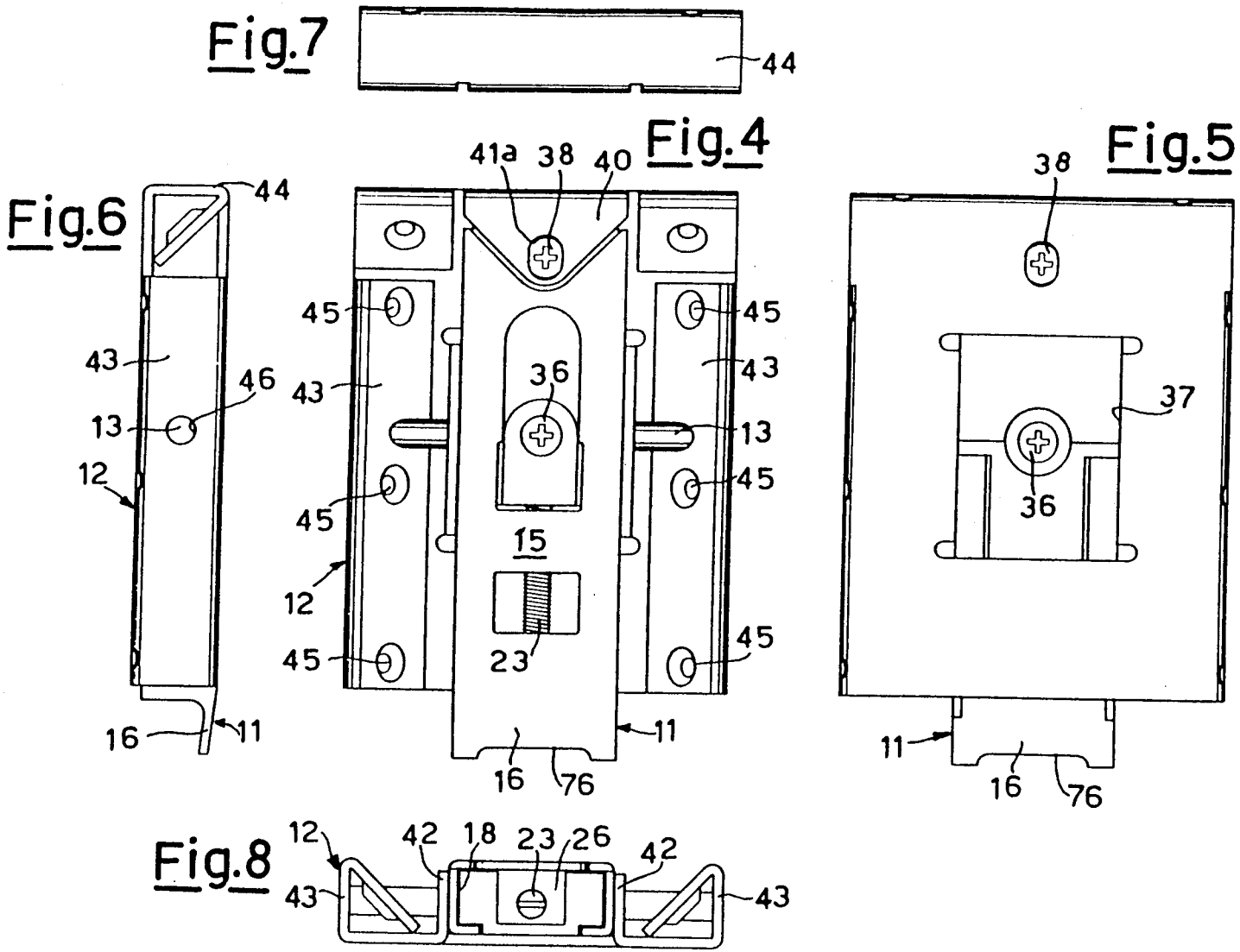
FIG. 4 is an elevational view showing the front of the device.
FIG. 5 is an elevational view showing the rear of the device.
FIG. 6 is an elevational view showing the side of the device.
FIG. 7 is a top plan view of the device.
FIG. 8 is a bottom plain view of the device.

The linkage 31, 32, 23, 26 and 25 (FIGS. 1 and 2) can be operated by one or other of two screw heads 36, which are integral with the respective pinions 31 and are accessible from the interior of the furniture item through a large aperture 37 in the plate 12 (FIGS. 2 and 5) and from the outside through an aperture 33*a* in the plug 33.

Alternatively, instead of providing the pair of pinions 31 and the toothing 32, a screw 123 with a slot 123*a* at its free end for a screwdriver can be provided (FIG. 2) to be able to slide the core and 14 and casing 15 relative to each other from the outside of the furniture item. In this case the head 129 of the screw 123 will be free of toothing.

The coupling module 11 is completed by a screw 38 (forming the second adjustment linkage) with heads for operation by screwdrivers at both ends, and which is screwed through a hole 39 at the upper end of the core 14. As can be seen from FIGS. 1-3 of the drawings, said screw 38 cooperates with an abutment 40 on the plate 12, behind which the upper end of the core 14 is wedged. The screw 38 can be operated either from the interior of the furniture item via a hole 41 in the plate 12 (FIGS. 2 and 5) or from the outside via a hole 41*a* in the abutment 40.

The plate 12 (FIGS. 1-8) comprises a central pair of opposing fins 42 for containing and guiding the coupling module 11, and is made into box form on the sides 43 and top 44 by bending the sheet metal inwards to define triangular sections which not only stiffen the system but also allow the device to be fixed to the furniture item as shown in FIGS. 11 and 12.

For this purpose said triangular sections 43 and 44 comprise a series of aligned holes 45 for the guided passage of fixing screws 75 (FIG. 11).

In addition, the sections 43 are provided with holes 46 aligned with the holes 47 in the fins 42, for passage of the pin 13. Said abutment 40 which collaborates with the screw 38 extends from the section 44.

The operation of the device of the invention is apparent from the aforegoing description with reference to the figures, and briefly is as follows.

The device assembled as shown in FIG. 3 is fixed by screwing the plate 12 to the side 48 and preferable also to the upper wall 49 (top) of an item of wall furniture, to the rear of the back panel 50 (FIG. 11).

At least two of such devices are provided per furniture item, one on each side, so that it can be hung onto the wall by engaging the coupling end 16 with a shaped bar 51 fixed to the wall (not shown), or with other equivalent elements such as hook plugs. It should be noted that the coupling end 16 is shaped with a cut-out 76 which ensures that the coupling element can be adjusted horizontally not only along a bar but also on a hook plug or the like.

When the furniture item has been hooked to the wall in the described manner, its position relative to the wall can be comfortably adjusted by adjusting the screws 36 and 38 or the screw 123. If the adjustment is made from the interior of the furniture item, the back panel will comprise two apertures with a finishing plug as shown in FIG. 12, whereas if the adjustment is made entirely from the exterior of the furniture item, the back panel will be without apertures, as shown in FIG. 13.

By turning the screw 38 in one direction or the other the furniture item can be moved away from or towards the wall by the relative rotation of the module 11 and plate 12 about the pin 13. If the screw 36 or alternatively the screw 123 is turned, the height of the furniture item can be adjusted by the relative movement between 14 and 15.

Figure 10:
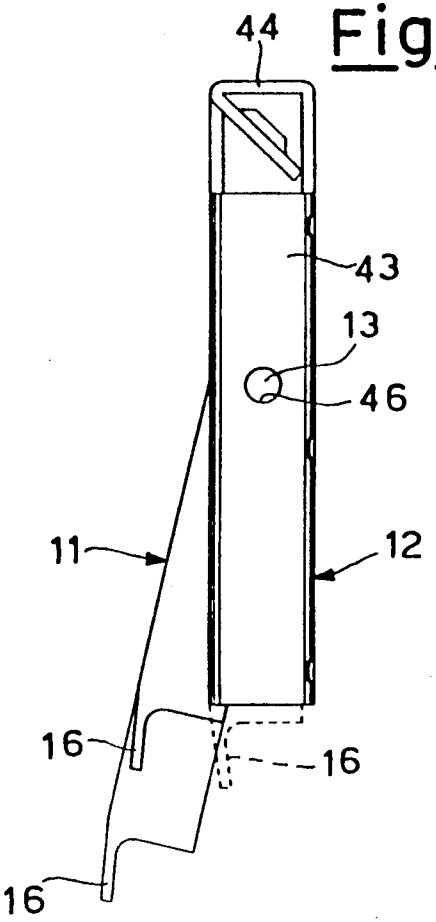
FIGS. 9 and 10 are a front and side elevation showing the facility for adjusting the coupling element of the device of the invention.
Figure 9:
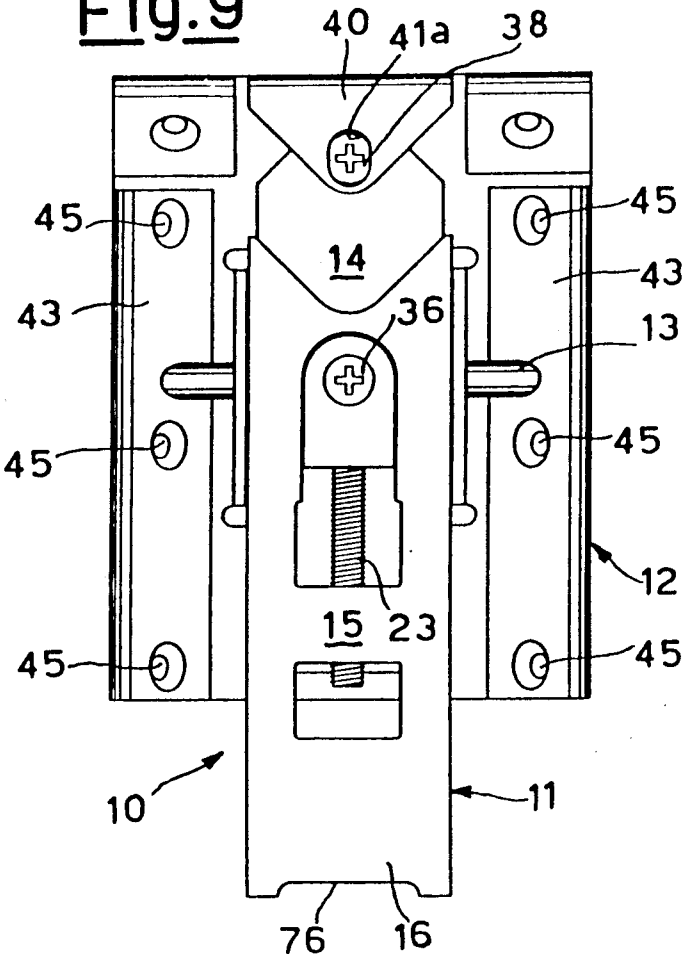

The available adjustments for the device of the invention and their ranges are apparent from FIGS. 9 and 10 of the drawings.

Access to the adjustment screws 36 and 38 from the interior of the furniture item is via holes provided on the back panel 50, said holes may be hidden for aestethical purposes by means of finish covering 52 (FIG. 12), or by simple plastic caps. Access to the adjustment screws 36 and 38 from the exterior of the furniture item is via the apertures 33*a* and 41*a* provided in the plug 33 and in the abutment 40 respectively.

If however a screw 123 with a slot 123*a* for a screwdriver at its free end is used (FIG. 3), i.e. dispensing with the pinions 31 and toothing 32, access to said screw 123 is available from the outside of the furniture item by operating substantially via the coupling module 11.

Figure 14:
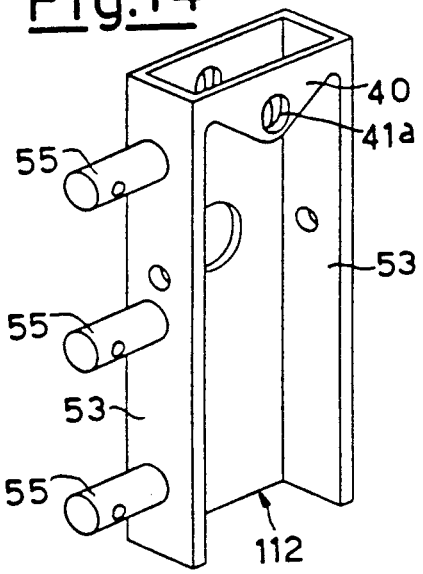
FIGS. 14 and 15 are two perspective views showing another type of plate (right and left) which can be used with the device of the invention.
Figure 15:
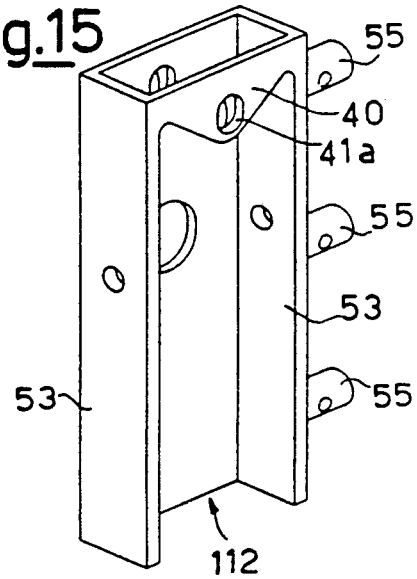
Figure 16:
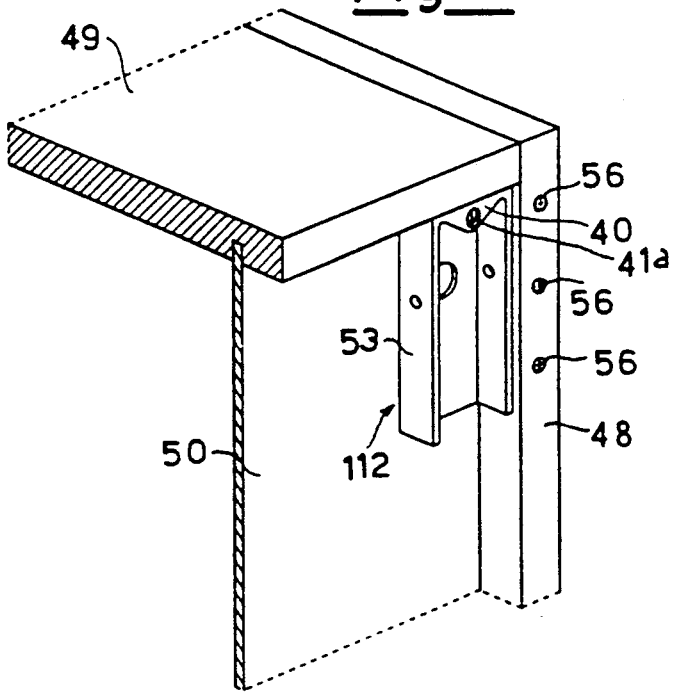
FIG. 16 is a perspective view showing the plate of FIGS. 14 and 15 fixed to the furniture item.

According to the present invention the coupling module 11 can be mounted on plates 12 of different type, formed according to the structure of the furniture item to which they are to be fitted, or according to the system used to fix them to the furniture item (manual or mobile), or according to their fixing position. FIGS. 14-16 of the drawings show a further non-limiting embodiment of plates 12 on which the coupling module 11 is mounted.

FIGS. 14 and 15 are perspective views of a plate 112 (right and left) having a box structure with side walls 53 and an upper wall 54 which between them receive the coupling module 11, having the same structure as shown in FIGS. 1 to 12 of the drawings. The side walls 53 are provided with bored pegs 55 for fixing the plate 112 to the item of wall furniture, the abutment 40 being formed on the front and extending downwards to cooperate with the screw 38 for adjusting the coupling module 11, in the manner heretofore described.

The system for fixing the plate 112 to the furniture item is shown in FIG. 16, in which it can be clearly seen how the plate 112 can be fixed at the corner formed by the side 48 and top 49, by housing the bored pegs 55 in holes provided in the side 48 and then fixing them by screws 56.

Figures 17, 18:
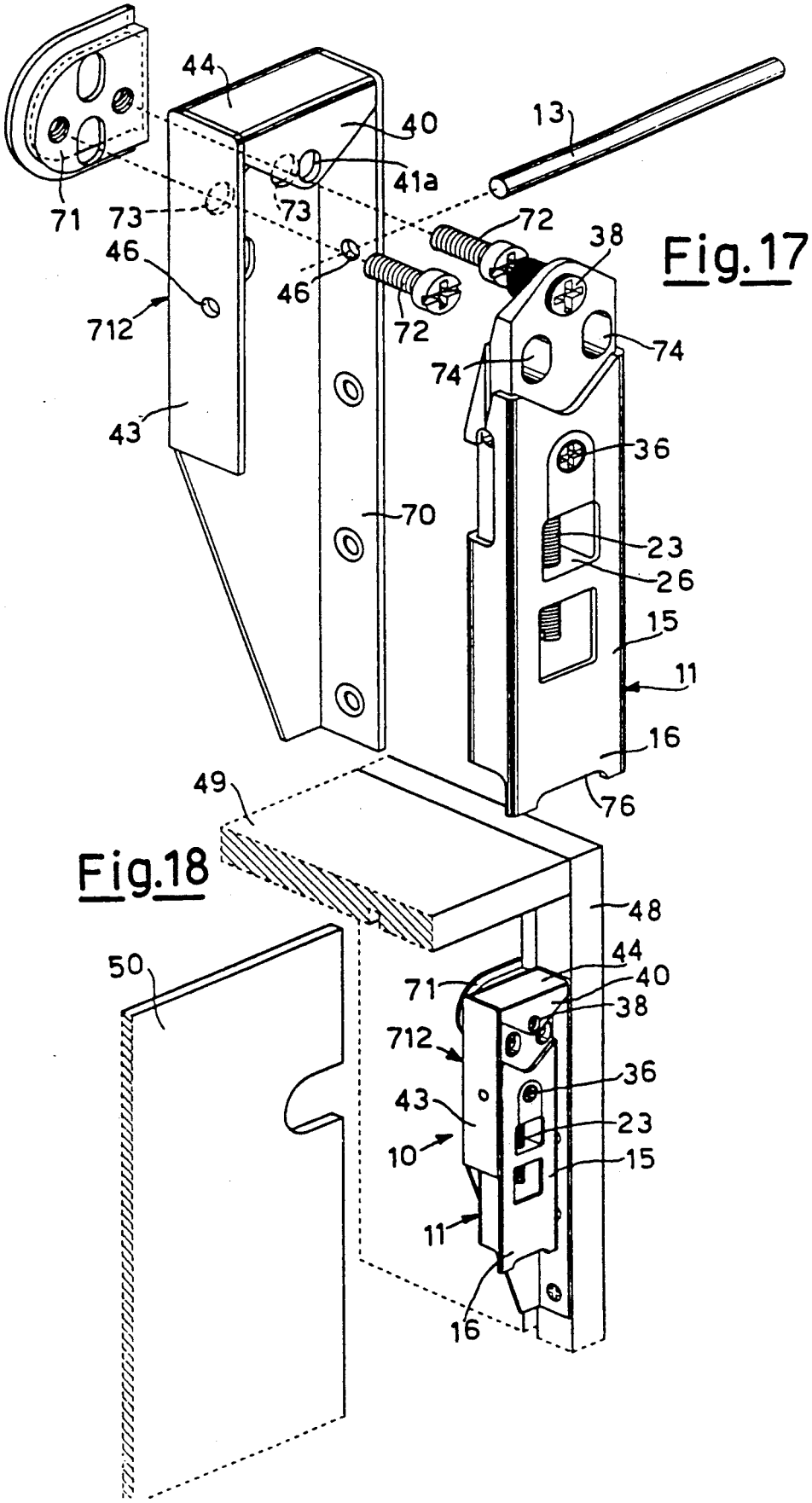
FIG. 17 is an exploded perspective view showing a further embodiment of the invention.
FIG. 18 shows the device of FIG. 17 fitted to a furniture item.

FIG. 17 shows a further embodiment of the invention in which the coupling module 11 is associated with a plate 712 having a box structure equivalent to that of the aforesaid plates but with a lengthened side wall 70 which is to be fixed to the side wall 48 of the furniture item, possibly some distance from its top 49. Characteristically, the fixing of the device to the furniture item is made secure by the collaboration of a jaw 71 which is tightened against the back panel 50 by a pair of screws 72 provided on the coupling module 11 and passing through holes 73 in the plate 712 and oval holes 74 in the coupling module 11.

FIG. 18 shows the system for mounting the device described with reference to FIG. 17, the device being fixed laterally to the side wall 48 of the furniture item and additionally tightened against the back panel 50, which is thus clamped between the jaw 71 and the plate 712. A cap is provided for the jaw 71, to complete the internal appearance of the furniture item.

From the aforegoing description it is apparent that the overall object of the present invention, i.e. to provide a coupling device in which a coupling module practically of universal type is in the form of an independent unit completely separate from the plate used for its fixing to the item of wall furniture, this plate having the most varied configurations according to the structure of the furniture item and the system used to fix the device to it. In addition, another important object is attained in that a very reliable coupling device is provided in which it is practically impossible to accidentally separate the coupling module from the plate, which in the limit could result in the fall of the furniture item with possible serious injury to the person. In this respect, the coupling module and the plate are interconnected by the strong pin 13, and withdrawal of the casing 15 from the core 14 is prevented by the stops 21, which engage against the pin 13.

Finally, it is also apparent that the object of providing a coupling device in which a coupling module practically of universal type enables all possible adjustments to be made either from the inside or from the outside, at the discretion of the user, is also attained.

I claim:

1. A concealed device for wall-mounting an item of wall furniture comprising, in combination: a plate to be fixed to the furniture item, a coupling element separate from said plate and arranged to engage a support member fixed to the wall, and said coupling element having first and second adjustment linkages acting between said plate and said coupling element to adjust both the vertical position of the coupling element relative to the wall and the angle formed between the plate and the coupling element, wherein the coupling element comprises an independent coupling module complete with said linkages.

2. A device as defined in claim 1, wherein said coupling module is pivoted to said plate by a transverse pin passing through the plate and the coupling module.

3. A device as defined in claim 1, wherein said coupling module has a core which is partially enclosed by an outer box casing having a projected end which defines actual coupling element of the device, said core and said casing being interconnected telescopically together to define a generally parallelpiped extending form, and between said core and said casing is located said first and second adjustment linkages, which are operable to allow relative movement between the core and casing and relative rotation between the coupling module and fixing plate respectively.

4. A device as defined in claim 3, wherein said casing further comprises lateral guides in which cut-outs are provided as end stops which cooperate with the pin.

5. A device as defined in claim 3, wherein said first adjustment linkages comprise a screw which is screwed into the box element, and at least one pinion adapted to engage with teeth provided on the head of the screw, and a housing closed by a shaped plug adapted for maintaining the head and the pinion securely in position.

6. A device as defined in claim 3, wherein said second adjustment linkages comprise a screw screwed through a hole at the upper end of the core and cooperating with an abutment on the plate, wherein the upper end of the core behind the abutment is wedged.

7. A device as defined in claim 1, wherein said plate is generally of box structure to receive the coupling module and also comprises a means for fixing said plate to the item of wall furniture.

8. A device as defined in claim 7, wherein said fixing means comprises a flange.

9. A device as defined in claim 7, wherein said flanges are provided with pegs.

10. A device as defined in claim 7, said fixing means comprises pairs of shaped lugs.

11. A device as defined in claim 1, wherein said plate comprises a central pair of opposing fins for containing and guiding the coupling module, and has a box structure formed by bending the sheet metal of its sides and top inwards to define triangular sections for stiffening the structure and for fixing the plate to the furniture item by screws guided to pass through aligned holes in said triangular sections.

12. A device as defined in claim 1, wherein said first and second linkages are accessible both from the inside and the outside of the furniture item.

13. A device as defined in claim 1, wherein said coupling module comprises a core partly surrounded by an outer box casing, and a projecting end defining the actual coupling element of the device, said core and said casing being interconnected telescopically together to define a generally parallelpiped extending form, and between said core and said casing is located said first and second adjustment linkages, which are operable to allow relative movement between core and casing and relative rotation between the coupling module and fixing plate respectively, said first adjustment linkages comprising a screw which is screwed into the box element, and two pinions engaged with teeth provided on the head of the screw, said pinions having heads adapted for receiving a screwdriver.

14. A device as defined in claim 13, further comprising a housing closed by a shaped plug adapted for maintaining the head and the pinions securely in position.

15. A device as defined in claim 14, wherein said second adjustment linkages comprises a screw screwed through a hole at the upper end of the core and cooperating with an abutment on the plate, wherein the upper end of the core behind the abutment is wedged, said screw comprising adjustment slots at both its ends for a screwdriver accessible from the interior of the furniture item through a hole in the plate and from the outside of the furniture item through a hole in the abutment.

16. A device as defined in claim 12, wherein said first adjustment linkages comprise a screw which is screwed into the box element and comprises at its free end a slot for a screw driver.

* * * * *